United States Patent [19]

Moncrieff-Yeates

[11] 4,131,105

[45] Dec. 26, 1978

[54] HEATING UNIT WITH VORTICAL AEROTHERMODYNAMIC FLOW CONTROL

[76] Inventor: Alexander J. Moncrieff-Yeates, 8924 Rhyme Court, Annandale, Va. 22003

[21] Appl. No.: 828,930

[22] Filed: Aug. 29, 1977

Related U.S. Application Data

[63] Continuation-in-part of Ser. No. 570,798, Apr. 23, 1975, Pat. No. 4,056,091.

[51] Int. Cl.[2] ..... F24B 7/00

[52] U.S. Cl. ..... 126/121; 126/131; 237/51

[58] Field of Search ..... 126/120, 121, 130, 131, 126/140; 165/168, 169; 237/51; 60/39.65, 39.69; 431/4, 158; 62/136, 170

[56] References Cited

U.S. PATENT DOCUMENTS

| | | | |
|---|---|---|---|
| 53,880 | 4/1866 | Rogers | 126/121 |
| 142,241 | 8/1873 | Kepler | 126/131 |
| 241,720 | 5/1881 | Ricketts | 126/130 |
| 1,526,541 | 2/1925 | Groth | 126/121 |
| 1,714,955 | 5/1929 | Helms | 126/121 |
| 1,952,281 | 3/1934 | Ranque | 62/170 |
| 2,185,788 | 1/1940 | Fredlund | 126/121 |
| 2,586,002 | 2/1952 | Carson, Jr. et al. | 62/136 |
| 2,642,859 | 6/1953 | Brown | 126/121 |
| 2,705,488 | 4/1955 | Wright | 126/121 |
| 2,821,975 | 2/1958 | Thulman | 126/120 |
| 3,007,310 | 11/1961 | Eisele | 60/39.69 |
| 3,030,773 | 4/1962 | Johnson | 60/39.65 |
| 3,096,754 | 7/1963 | Howrey | 126/120 |
| 3,118,489 | 1/1964 | Anthes | 431/158 |
| 3,255,802 | 6/1966 | Browning | 431/4 |
| 3,258,052 | 6/1966 | Wilson et al. | 431/158 |
| 3,372,689 | 3/1968 | Goudy | 126/140 |
| 3,896,785 | 7/1975 | Nelson | 126/121 |

FOREIGN PATENT DOCUMENTS

| | | | |
|---|---|---|---|
| 675375 | 2/1930 | France | 126/120 |

*Primary Examiner*—Ronald C. Capossela
*Attorney, Agent, or Firm*—Sixbey, Friedman & Leedom

[57] ABSTRACT

A flow controller is constructed to induce a stable unrestrained vorticity pattern in a position where its circumferential expansion into the flow path acts as a self-adjusting impedance to the flow. The controller finds particularly advantageous utility in a furnace, stove, or fireplace.

10 Claims, 6 Drawing Figures

Fig. 1
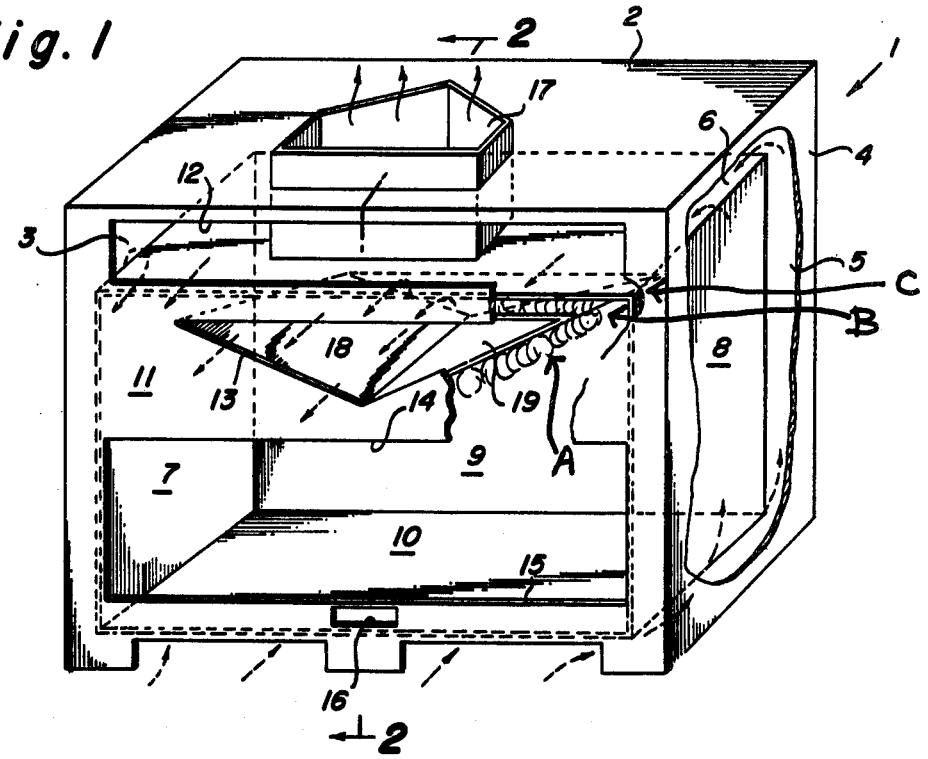
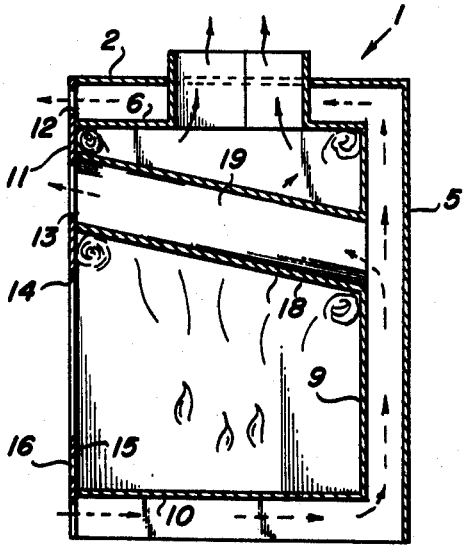
Fig. 2
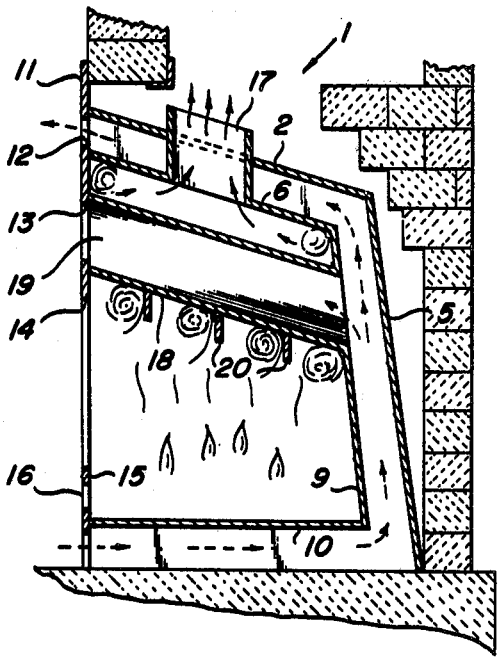
Fig. 3

HEATING UNIT WITH VORTICAL AEROTHERMODYNAMIC FLOW CONTROL

RELATED APPLICATIONS

This application is a continuation-in-part of my application Ser. No. 570,798, filed Apr. 23, 1975 and entitled VORTICAL FLOW AEROTHERMODYNAMIC FIREPLACE UNIT, now U.S. Pat. No. 4,056,091.

FIELD OF INVENTION

This invention relates to flow controllers generally, and particularly to furnaces and to fireplaces and fireplace insert units, and is more particularly applicable to furnaces and fireplace units wherein room air is circulated, either by convection or by mechanical forcing means, in heat exchange relationship to a combustion chamber and returned to the room in heated condition.

BACKGROUND OF INVENTION — PRIOR ART

Considering first the prior art relating to air circulating fire places, it is known to construct fireplaces or inserts therefor which provide means to circulate room air through passages in the walls defining the combustion chamber to absorb heat from the source, after which the heated air is returned to the room. This art includes elaborate labyrinthian passages for the room air and combustion air alike in an attempt to lengthen the period of residence of the respective flows in mutual heat exchange relationship, as exemplified by U.S. Pat. No. 2,642,859, issued June 23, 1953 to Newman T. Brown. Moreover, it has been proposed to so dimension the combustion chamber that an unconfined slowly descending recirculating flow of combustion air is encouraged, as seen in U.S. Pat. No. 773,863, issued Nov. 1, 1804 to Mary F. Frecktling, and to provide a confined passage in which to induce a recirculating flow of hot combustion gases as in U.S. Pat. No. 3,096,754 issued July 9, 1963 to H. C. Howry and in U.S. Pat. No. 53,880, issued Apr. 10, 1866 to Francis M. Rogers. It is noted that the Frecktling disclosure recirculates only the slowly moving portion of the combustion products, the principle heat containing portion passing directly to the flue. On the other hand, the Rogers and the Howry disclosures, in which substantial portions of the combustion flows are recirculated in confined paths, require the introduction of structural impedance to the gas flow and depends upon the presence of a large expanse of heat exchange surface.

Also, it is known in fireplaces generally, with or without provision for recirculation of room air, to provide structures which inherently may produce eddy currents of hot gases which do not follow a well defined and stable flow pattern recognized to have a desireable effect on flow of combustion gases within the fire enclosure. One such structure is seen in U.S. Pat. No. 142,241, issued in Aug. 1873 to Kepler and in U.S. Pat. No. 241,720 issued in May 1881 to Ricketts.

Turning to the art relating to combustion generally, it is well known to induce a helical flow of a fuel/air mixture in order to increase the residence time of the mixture within the combustion zone and thus enhance complete combustion, and it has been suggested that such an effort may be augmented by restricting the outlet of the combustion chamber or by introducing a supplemental forced air flow. For an example of this art, reference is to U.S. Pat. No. 3,007,310, issued Nov. 7, 1961 to Karl Eisele and to U.S. Pat. No. 3,258,052 issued June 28, 1966 to Alfred Wilson, et al. Augmentation of the spiral flow of air/fuel mixture has also been proposed by flow conditions which induce an annular tore comprising a flame vortex adjacent the base of the flame in U.S. Pat. No. 3,030,773, issued Apr. 24, 1962 to Robert H. Johnson and in U.S. Pat. No. 3,255,802 issued June 14, 1966 to James A. Browning. A similar flow is induced within the area of air/fuel mixing in U.S. Pat. No. 3,118,489, issued Jan. 21, 1964 to Clifford C. Anthes.

Considering the prior art even more generally, in the field of heat exchange it is known to induce a gaseous medium to flow in a vortical pattern extending axially of a tubular conduit in order to increase residence time, enhance scrubbing action and to obtain an interchange of position of the molecules of high velocity and temperature gases from the center of the vortex with the outer molecules which have been deprived of their energy and velocity through functional heat exchange contact with the vortex tube in which the vortical flow is confined. This is exemplified by the well known "Ranque" tube (U.S. Pat. No. 1,952,281, Mar. 27, 1934) and see U.S. Pat. No. 2,586,002, issued Feb. 19, 1952 to W. R. Carson, Jr. et al, and U.S. Pat. No. 3,266,466 issued Aug. 16, 1966 to Eugen Fehr.

In U.S. Pat. No. 3,229,470, high pressure gas is accelerated in a vortex constrained within a volute chamber in order to throttle an escape aperture situated axially of the pattern.

In summary, the prior art is known to disclose inducement of vortical flow in precombustion gases and basal portions of flame patterns for the purpose of enhancing the mixing of the fuel air mixture, and the prior art discloses inducement of hot gas vorticity axially of confined conduits of heat exchangers. Additionally, prior art is known wherein high velocity gas is accelerated in a vortex pattern to throttle passage through an axially disposed aperture.

OBJECTS OF INVENTION

In contradistinction of the foregoing, it is among the objects of this invention to provide a fluid control structure including features by which 1. a stable, relatively unconfined flow of hot gases is induced and maintained throughout varying conditions of temperature and velocity,
2. the vortex serves to divert air entering the flame enclosure of a furnace or fireplace downwardly into the fire zone of the enclosure,
3. the vortex of hot gas is permitted to expand into the hot gas flow pattern entering and exiting the fire enclosure whereby the fluid impedance varies within variations in hot gas velocity,
4. a vortical hot gas flow pattern is maintained in a heat exchanger which prevents minimal structural impedance to gas flow,
5. a hot gas flow path is maintained free of areas of aerodynamic stagnation,
6. a self-regulating draft is established by vortex imposed aerodynamic impedance,
7. the structure is readily adaptable to domestic furnace or fireplace installation as original equipment or as a modification of preexisting conventional fireplaces or furnaces, and
8. a flow controller of general applicability to fluid systems is provided which employs the advantages set forth above.

DESCRIPTION OF DRAWINGS

The aforestated objects, as well as other objects inherent in the apparatus of this invention will be apparent from a consideration of the ensuing specification and reference to the drawings, in which FIG. 1 is a perspective view of a fireplace unit having portions of the front end and one side broken away to reveal interior features in cross section, FIG. 2 is a elevational cross section taken through line 2—2 of FIG. 1, FIG. 3 is a view similar to that of FIG. 2 of an alternative embodiment.

TERMINOLOGY

Figure 4:
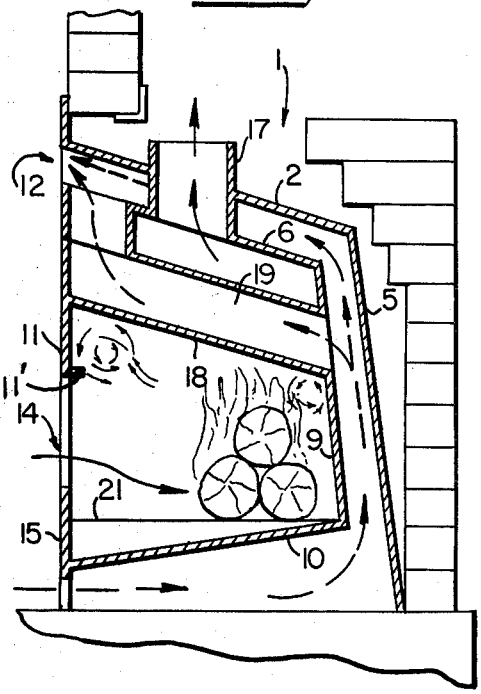
FIG. 4 is a view similar to that of FIG. 2 of another alternative embodiment.

This description includes reference to the phenomena of heat exchange between a heated high velocity gas induced to flow in a relatively confined vortical pattern in close proximity to a heat exchange surface through which heat is transmitted to a relatively cooler fluid. In order to maintain a distinction between the aforementioned prior art in which vortical patterns are produced at basal portions of a flame for the purpose of enhancing combustion, this specification will refer to the heated gas as the donative gas and to the cooler fluid as the recipient gas. Thus, donative gas is that gas which has been brought to a temperature condition where it is ready to be introduced into the heat exchange relationship and may include portions of the flame in which combustion is sufficiently complete to have brought about the aforesaid temperature condition, as well as combustion products immediately downstream of a flame. Recipient fluid, on the other hand, is any fluid, i.e., liquid or gas, which received heat from the donative gas.

DESCRIPTION OF INVENTION

Referring first to FIGS. 1–4, the heating units of this invention are depicted fireplace units, each comprising an outer enclosure generally designated 1 and including a top wall 2, side walls 3 and 4, and a back wall 5. While these units are depicted as fireplace inserts, it should be understood that the same units may be used as other types of heating units, such as stoves or furnaces wherein the recipient air passages are connected to air supply and return duct systems which distribute air throughout a building, or as inserts in an existing furnace structure. Moreover, the term "fireplace" is meant to include free standing fireplaces where the duct 17 is connected directly to flue ducts leading exteriorly of the heated enclosure rather than opening to a chimney flue. Spaced inwardly from said outer enclosure walls is a fire enclosure defined by a top surface which may be a flame plate 18 (FIGS. 1–4), or 19 (FIG. 6) or top walls 2 (FIG. 5) or 6, side walls 7, 8, a back wall 9, and a bottom 10. Both enclosures share a common partial front wall 11 extending downwardly from the top wall 2 and defining a plurality of openings, namely an upper recipient gas exit at 12, a lower recipient gas exit at 13, and a fire enclosure opening at 14. A barrier lip 15 on the front wall which is immediately superjacent to the fire enclosure bottom 10 for purposes to be elaborated on in the ensuing specification, includes one or more openings 16 to provide the entrance of combustion air. These openings may be provided with appropriate flow control valves (not shown) to provide controllable draft. A combustion gas exhaust passage for communicating the fire enclosure with a flue is defined by a duct 17. FIG. 3 discloses an alternative embodiment configured so as to be particularly adaptable to existing fireplaces, and wherein the backs 5, 9 and top 2 are sloped.

Another alternative embodiment is illustrated in FIG. 4 wherein the duct 19 joins the upper recipient air passageway defined by walls 2 and 6 and exits through a common recipient gas exit at 12, it being further understood that a single duct could be provided without departing from the concept of this invention.

Figure 5:
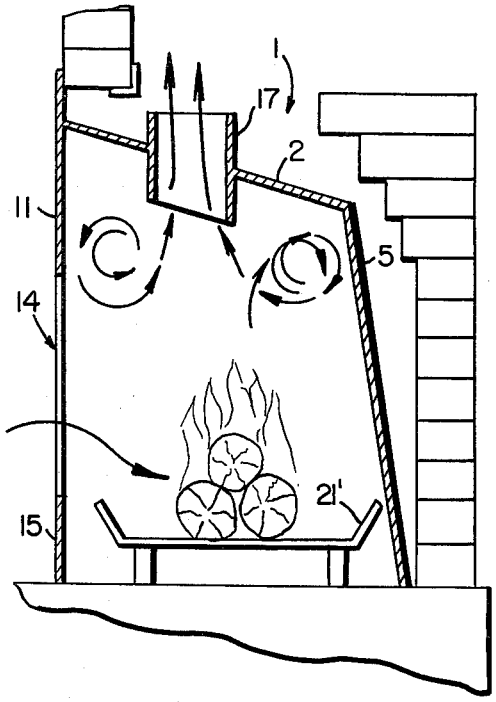
FIG. 5 is a view similar to that of FIG. 2 of still another alternative embodiment.

Still another alternative embodiment is illustrated in FIG. 5 in the form of a fireplace which does not include provision for recirculating room air through the unit, and wherein the fuel is supported by a conventional grate 21' at a level below the barrier lip 15.

A still further alternative (not shown) would eliminate the outer enclosure and utilize the existing fireplace enclosure in lieu thereof.

In FIGS. 1–4 the path of the room air through the unit, wherein it is termed recipient air to denote its function of reception of heat for conveyance to the room area by convection, is traced by dashed line arrows, whereas the path of heated combustion products, termed donative gas, is denoted by solid line arrows. In the latter regard, particular attention is invited to the path of the donative gases (which may include the flame under some conditions and/or the intensely heated gases downstream of the flame under other conditions) by which they are brought in contact with the undersurface 18 of a duct 19 interconnecting the recipient air passage through an opening in rear combustion chamber wall 9 with the recipient duct exit 12 or 14. In FIG. 5 the contact is with the undersurface of the top wall 2 which functions as the flame plate in the ensuing description. The undersurface forms a flame plate whereby, at the points of juncture of this flame plate duct 19 with the partial front wall and with the rear wall, the donative gas flow is induced to flow in a pattern of vorticity which remains stable throughout a wide range of temperature and velocity. Again, after leaving the aforementioned vorticity areas, the combustion gases pass through an aerothermodynamic control opening B and encounter the respective junctures of the back and front walls 9 and 11 with the flame enclosure top wall 6, vortical flow patterns are maintained or reestablished and maintained in a stable persistent pattern throughout varying flow conditions. In the present model, four front vortices exist under all tested operating conditions and four extensions or additional (rear) vortices arise when the fire is disposed sufficiently rearwardly in the flame enclosure. Additional vortices may be induced by the provision of lateral fins 20 (FIG. 3) to the underside of the flame plate surface 18. These fins serve to augment the stabilization of the aforementioned vortices and to establish additional vortices either independently under high velocity conditions, or as the original stable vortex increases in translational velocity and in circumference to a point where it overflows the partial barrier formed by the fin and adopts a vortical flow pattern in the adjacent channel defined by the flame plate 18 and the fins 20.

While depicted in FIG. 1–5 as a complete insert unit, it is readily apparent that the essence of this invention is equally applicable to an insert which utilizes an existing fireplace as the flame enclosure, and wherein the insert includes only the flow diverting flame plate, and the vortex defining juncture is formed of additional flow diverting elements extending from a juncture with the flame plate toward the flame.

Figure 6:
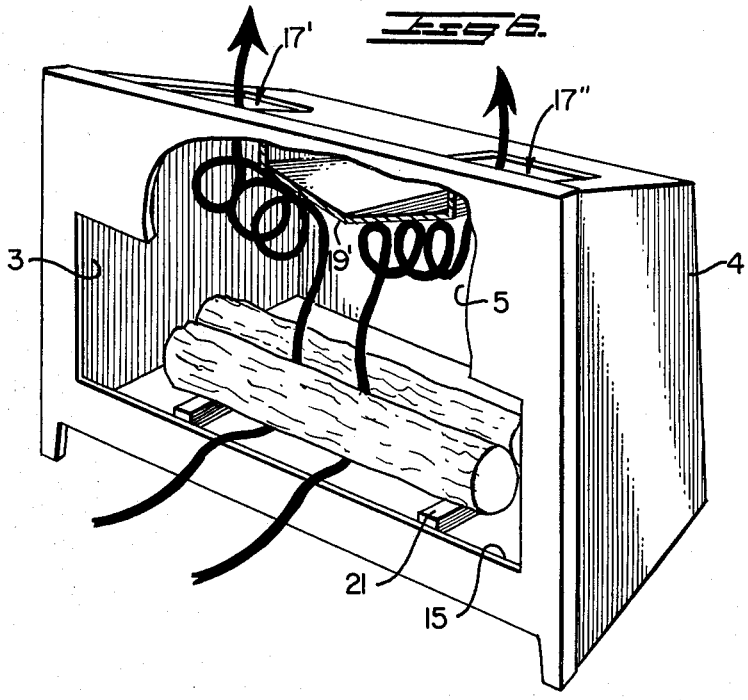
FIG. 6 is a view similar to that of FIG. 1 of another embodiment.

FIG. 6 illustrates an embodiment wherein two duct openings 17′ and 17″ are provided in lieu of the single central opening 17 of the other embodiments. This structure provides for a diverging flame plate 19′ about to be described in a unit which does not include both upper and lower ducts as in FIGS. 1–4.

In each instance, the stable vortical patterns of donative gas flow are established by structure which presents a partial barrier (i.e. the underside 18 of the flame plate duct 19 or 19′ and the top 2 or 6 of the flame enclosure) to the otherwise free unobstructed flow of hot donative gas toward the flue while permitting the flue to draw off gases from the end of the vortexes so formed. The latter function is enhanced by slanting the barrier in its longitudinal direction upwardly in the direction of gas flow so that the long axis of the vortex coincides with the predominent direction of ultimate gas flow and thus leads toward the flue opening.

In the heat exchanger of the instant application, a portion of the hot air rising from the heat source encounters the flame plate 18. A combination of structural features, including the inclined back wall 9, the forwardly sloped flame plate 18, and the inducement of the forwardly positioned exit flue duct 17 tend to divert the hot gas forwardly of the unit. As the gas scrubs the underside of the flame plate, the boundary layer donates heat to the recipient gas within the duct 19, thus creating a pressure gradient decreasing with distance below the boundary layer. To this end, the flame plate must be at a small enough angle to the initial direction of the gas flow as to avoid stagnation or eddys, yet substantial enough to create the heat exchange and establish the pressure gradient which sets the scene for the next step in creating the vortex. As the gas approaches the juncture with the front wall 11, it is deflected, the pressure gradient acting to pull the gas downwardly rather than allowing it to sidle along the juncture in the direction of the flue. The boundary layer continues to exchange heat, this time through the wall 11, thus maintaining or increasing the pressure gradient to pull the air inwardly of the unit, this pull being augmented now by the flow of air entering the access opening at 14. Still further augmentation may be attained by provision of a deflecting lip 11′ (FIG. 4).

Next, the flow, which has completed a reentrant turn in direction, pushes the entering air downwardly, causing a reactive force which pushes the vortical air upwardly, still augmented by the same pressure gradient. Moreover, the flow is again augmented, now by hot gas rising from the heat source, thus completing a full convolution to initiate a vortex.

Now, the vortex thus initiated would remain unstable and indeed terminate if the aforedescribed pressure gradient were not maintained by continually removing cooled gas from the vortex. This removal is achieved in part by drawing gas from one end of the vortex to maintain an additional pressure gradient along the axis of the vortex. In the preferred. embodiment, this is accomplished by a combination of the diverging configuration of the flame plate and the positioning of the exhaust paths at the extreme ends of the vortex pattern area. In addition to this axial withdrawal of exhaust gases, a certain quantity of gas at the outer circumference of the vortex will mingle with the gases passing directly to the flue, and thus be withdrawn from the vortex. When the total rate of removal of gases from the vortex both axially and centrifugally is equal to the rate of entry of the gases into the vortex pattern, a stable condition is created wherein a balance exists between the effects of the pressure gradient and the effects of centrifugal force.

Furthermore, maintenance of a stable vortex pattern requires that the circumference of the pattern be able to expand and contract as velocity increases or decreases. By such action, the vortex acts to balance the centrifugal forces created by velocity against the centripetal forces created by the aforementioned pressure gradient. To this end, the vorticity area is maintained open to the flame enclosure thereby avoiding structural constraint of the circumference of the pattern. Velocity changes of the incoming air are thus absorbed in the longer path of travel in each convolution. Little change occurs in the axial distance of each convolution, hence residence time within the vortex area remains essentially constant.

In addition to the aforementioned longitudinal slant of the flame plate 19, it is desirable to provide a pitch in a direction transverse to the slant direction, thus to establish an axial flow within the vorticity pattern. To this end, the flame plate 19 should have a transverse pitch of approximately 15°, the pitch being transverse to the slant and directed upwardly to a free edge, which edge coacts with a contiguous area of the enclosure wall 8 to define a portion of the donative gas flow path therebetween. In the preferred embodiment wherein the flame plate 19 extends through the center of the enclosure, thus dividing the enclosure into two donative gas flow portions, the flame plate diverges laterally outwardly from a longitudinal central portion of the plate to terminate at two free edges defining the two flow path portions.

A preferred size prescribes a horizontal minor dimension of 22 inches, a vertical minor dimension of 3 inches, and a divergent pitch of 15° in the flame plate surface. This pitch is established at 0.5 to 2 times the slant angle of flame plate duct 19 from the rear wall 9 to the partial front wall 11. The aim is to present a partial barrier to the upward donative gas flow, thus causing the gas to arrive at the aforementioned junctures and form vortices commencing at the low point (center portion) of flame plate 19 and extending upwardly in each lateral direction to terminate at a free edge of said flame plate spaced from a contiguous portion of the enclosure side wall.

The cross sectional pitch configuration and longitudinal slant of the duct also has certain beneficial effects on the flow therethrough of recipient gases. First, the combination of upward pitch from front to rear and from center to sides tends to encourage lateral flow patterns with in the flame plate duct 19 by virtue of the increased tendency of the heated recipient gas to lift off a sloped surface. Thus, slowly spiralling counterrotating recipient gas currents occuring at respective sides of the center line of the duct disrupt otherwise lamellar flow patterns, whereby to assist the susceptibility of the recipient gas to heat exchange. Secondly, this circulation is enhanced by providing sufficient height at the extreme lateral extent of the flame plate 18 for the lift off of recipient gas to occur, tending toward an equalization of flow through the duct 19 at its center and at its sides. The sides of duct 19 should be limited in height inasmuch as they are not in proximity to the vortices of the donative gas and hence are relatively ineffective as heat transfer surfaces.

The sum of the areas of the two recipient gas exits 12 and 13 with respect to the area of the bottom air inlet should be such that the mass flow of the inlet gas at room temperature approximates the sum of the mass flow of the recipient gas at the respective temperatures of exit, which have been found typically to be 200° F at exit 12 and 300° F at exit 13.

In working model, stable vorticies were maintained at rotational speeds of approximately 100 rotations/-second in a vortex of 4 inches diameter while the longitudinal velocity is about 2 feet/second. Since, in this example, heat transfer surface is present around half of that circumference, an effective exchange surface path over a one foot segment of the distance from fire to flue is $$100 \times \pi \times 4/12 \times 2 = 50 \text{ feet}$$

Where the heat exchange surface surrounds more than half of the vortex, the denominator is correspondingly decreased. Since each vortex is 2 feet long, the effective scrubbing or heat exchange surface is $50 \times 2 = 100$ square feet, whereas the volume of each vortex is $$\pi \times 4^2 \times 2/144 \times 4 = 1/6 \text{ cubic feet}$$

The vortices tend to decrease the effective size of the donor gas conduit to the flue by expanding into the open area of the flue, or stated conversely, tend to increase the aerodynamic impedance. Empirical design can achieve a self adjusting system wherein the effective flue impedance is least when the convection is least and increases as convection increases.

This self control of the donor gas flow as an inverse function of the energy supplied to it by the heat source occurs in two steps. As the energy supplied increases so does the diameter of the vortices, such as that shown at A in FIG. 1. The increased diameter of a vortex in the opening at B, between the edge of the duct 19 and the side of the firebox 8, will fill more of that opening than when the diameter is less. The opening at B thus becomes a control opening wherein the more the opening is filled by the flowing vortex the higher the aerodynamic impedance to any increased flow through the opening. This in turn restricts the flow through the heat source, thereby controlling its rate of combustion.

At high energy flux a second vortex tends to feed into the rear of the opening at C. The joint action of both the vortices expanding in diameter with increased supply of energy provides more rapid increase of impedance or "throttling" in said opening.

It has been found that the control provided by the vortices in said manner is more rapid than that caused by lamellar flow of these gases through the opening at B.

The consequence is that the heat source is regulated to maintain a constant energy flux determined by the relative impedance of said opening to the other impedances of the system, such as that presented at the enclosure access opening by the draft plate 15 and that presented at the flue 17. This has been observed in that extra fuel can be added to the heat source without accelerating the rate of burn. Further evidence is that the heat source will burn at a constant level as the fuel is consumed, and not flare up and then quickly die down as in an uncontrolled heat source.

Wood fires, with 20 lbs. of fuel, which in a fireplace would last ½ hr., have been observed to maintain a steady flame for 4 hours in the described system.

Considering front and rear vortices, it is evident that an increase in diameter of the adjacent vortices brings about an increased choking effect to the straight flow of gases therebetween, thus serving as a damper to increase aerodynamic impedance as fire intensity increases. The design should preserve a consistency of aerodynamic impedance throughout the flow path of the donor gas, i.e., the sum of the effective cross-sectional open air areas in the upper reaches of the combustion chamber should approximately equal the cross-sectional area of the flue duct 17, which is smaller than the average chimney flue in cross-section. Moreover the partial barrier formed by the undersurface 18 of the duct 19 must be substantial and has been found to be most effective when the width of the duct approximates ¼ or more of the total width of the flame enclosure. An optimum total flue duct opening 17 (or 17′+17″) is 48 square inches. Inasmuch as the slant angle of the flame plate 18 serves to direct the major donative gas flow toward the juncture with the partial front wall 11, the one front juncture is the first to form a vortex and is the preferred heat exchange area. Hence, it is desirable to position the flue duct so as to induce the major donative gas flow in the front of the enclosure. Flue duct openings as large as 64 square inches are feasible, as are variations in cross sectional configurations, such as square, rectangular, trapezoidal, parallegram. In any configuration, however, the major area of the opening should reside in the front half of the top 6 where it is downstream of said one front juncture.

Another design factor which has a surprisingly significant effect on the overall balance of aerodynamic impedance is the impedance presented by the barrier lip 15 which extends substantially to or somewhat above the level of fuel support within the enclosure. Surprisingly, the width and height of the opening above the lip 15 have little effect, yet a barrier lip which is too low results in instable vortices and inefficient draft. It appears that the predominant flow of combustion air into the flame chamber is through the lower portion of the opening superjacent to the lip 15. Hence, the effect of the height of this barrier lip relative to the position of the fire is significant due to input damper effect on the predominant flow.

The flow path of the hot donative fluid along the underside of plate 18 and then downwardly along the inside surface of plate 11 in FIG. 1 is contrary to any flow which tries to occur from the room through the upper portion of opening 14 and upwardly to the flue. Alternatively stated, the aerodynamic impedance of opening 14 to flow into it is very high near the top of the opening. This counter flow leading into the vortices in contact with plate 11 has little effect at the more remote lower reaches of opening 10, as at the lip 15. Hot fluid rising from the heat source at 10 will tend to pull new combustion fluid over the lip 15 then downward under and up through the heat source.

It is for this reason that fuels burning in this system have been observed to combust at higher temperatures and hence more thoroughly then in other systems. A typical fireplace burns with a yellow flame measured as having a temperature of 1100° F, while the same fuel has burned at 1700° F in the described system. The higher temperature increases the efficiency of the system, which has been measured as being about 65% overall, and the more complete combustion reduces deposit of creosotes and other products in the flue.

In view of the pronounced effect of the impedance offered by the relative height of barrier lip 15 in relation to the fire, it is proposed in an additional embodiment to provide an inbuilt grate structure whereby the fire will be supported at a predetermined height which is not dependent upon that of an independently acquired grate. Such a structure is illustrated in FIGS. 4 and 6, wherein a pair of spaced grates 21 extend from front to rear.

While described in the foregoing specification in several preferred embodiments, the aerothermodynamically controlled concept of this invention may be in other units which employ design deviations from the specific structures set forth. Hence, the scope of this invention is not considered to be limited by the specification, but should be considered in accordance with the following claims.

I claim:

1. In a heating unit including a fire enclosure defined in part by a back wall, side walls, a top surface, and having at least one flue opening, and a front wall extending downwardly from a juncture with a front portion of said top wall and including a fire enclosure access opening therein, the improvement wherein A. said fire enclosure access opening is defined
   a. at its upper extent by a first edge of said front wall disposed substantially below the enclosure top wall and
   b. at its lower extent by a second edge of said front wall disposed substantially above the lower extreme of said fire enclosure at a position substantially at least as high as the level of support of fuel in said enclosure, B. the area of said juncture of said top and front walls defining throughout the extent of said juncture a laterally extensive aerothermodynamic vorticity area open to the flame enclosure generally and wherein heated air is induced to whirl in at least one vortex pattern having an axis parallel to said juncture, C. said flue opening being effective to draw exhaust gases from said pattern to maintain stability of said pattern, whereby the circumference of said pattern increases in direct proportion to the velocity of heated air flow and hence expands into the area between the level of the upper extent of said access opening and said flue opening to divert the flow of air entering said access opening downwardly to the level of fuel support.

2. The heating unit of claim 1 wherein said flue opening is disposed axially of said pattern area to define a thermal control opening into which said induced vortex pattern extends, the presence of said vortex in said flue opening serving to throttle the flow of heated gases therethrough to an extent proportional to the circumference of said vortical pattern and the resultant diversion of the room air entering the access opening, thereby to maintain a constant ratio of aerodynamic impedances to gases entering said access opening and to gases exhausting through said flue opening.

3. The heating unit of claim 1 wherein said enclosure top surface includes a flame plate which slants upwardly toward at least one fire enclosure side wall and terminates short of said side wall to define a thermodynamic control opening therebetween into which said induced stable vortex pattern extends, the presence of said vortex in said control opening serving to throttle the direct flow of heated gases to said flue opening to an extent proportional to the circumference of said vortical pattern and the resultant diversion of the room air entering the access opening, thereby to maintain a constant ratio of aerodynamic impedances to gases entering said access opening and to gases exhausting through said control opening.

4. The heating unit of claim 3 wherein the said first edge of said front wall includes a lip extending inwardly of said fire enclosure.

5. The heating unit of claim 3 wherein said flame plate diverges upwardly and outwardly toward the fire enclosure side walls and terminates at edges spaced from said side walls to define thermodynamic control openings therebetween into each of which at least one of said induced stable vortex patterns extends, the presence of said vortex in said control openings serving to throttle the direct flow of heated gases to said flue opening to an extent proportional to the circumference of said vortical pattern and the resultant diversion of the room air entering the enclosure access opening, thereby to maintain a constant ratio of aerodynamic impedances to gases entering said access opening and to gases exhausting through said control opening.

6. The heating unit of claim 5 including two said flue openings, each of which is disposed above a respective control opening.

7. The heating unit of claim 1 wherein the juncture of back wall and said top wall defines an additional aerothermodynamic vorticity area wherein heated air is induced to whirl in at least one stable vortex pattern the circumference of which increases in direct proportion to the velocity of heated air flow, the patterns of said first mentioned vortex and of said additional vortex defining therebetween an area of control of hot air passing to said flue wherein the aerodynamic impedance is increased by the expansion of the respective pattern circumferences toward each other.

8. A method of directing and throttling the flow of a gas through a heating unit from a fire enclosure access opening to an exhaust flue, said method comprising the steps of inducing a flow of air to enter said enclosure through said access opening and to exit said exhaust flue by burning the fuel at a low point within the enclosure, diverting a portion of heated air arising upwardly above said fire into a vortical flow pattern positioned between said access opening and said flue, the circulation of said vortical pattern being downwardly toward said access opening, and permitting the velocity of said vortical flow to increase upon increased fire intensity to thereby expand the circumference of said vortical flow pattern whereby said pattern expands into the flow path of entering air to direct the flow of entering air downwardly toward the fire and to increase the aerodynamic impedance to the flow of entering air, and said pattern also expands into the flow path of exiting air to increase the aerodynamic impedance to the flow of exiting air to said flue.

9. The method of directing and throttling the flow of a gas through a heating unit as the method is set forth in claim 8 wherein said vortical flow pattern is stabilized by exhausting gases therefrom at a rate equal to the rate of flow of said diverted gases.

10. A method of throttling the flow of gas through an enclosure from an inlet opening to an exhaust opening, said method comprising the steps of inducing a gas to enter said inlet opening, to flow through said enclosure in a path leading to said exhaust opening and to exit said exhaust opening, initially diverting a portion of said flow from said path into a vortical flow pattern area positioned between said inlet opening and said exhaust opening, further directing said diverted portion in a re-entrant flow direction, creating a low pressure condition between said initially diverted flow and said further reentrantly directed flow to establish a vortical flow around said low pressure area, maintaining said vortical flow by removing gas from said vortex pattern area at a rate substantially equal to the rate of flow of said initially diverted gas, and permitting said vortical flow to increase in circumference upon an increase in flow velocity, whereby said vortical flow pattern expands into said enclosure flow path to increase the dynamic impedance to the flow of air through said enclosure.

* * * * *